US010149801B2

(12) United States Patent
Conner et al.

(10) Patent No.: US 10,149,801 B2
(45) Date of Patent: Dec. 11, 2018

(54) BREASTFEEDING APPARATUS SYSTEM

(71) Applicants: Matthew Conner, Alexandria, VA (US); Michelle Conner, Alexandria, VA (US)

(72) Inventors: Matthew Conner, Alexandria, VA (US); Michelle Conner, Alexandria, VA (US)

( * ) Notice: Subject to any disclaimer, the term of this patent is extended or adjusted under 35 U.S.C. 154(b) by 0 days.

(21) Appl. No.: 14/927,403

(22) Filed: Oct. 29, 2015

(65) Prior Publication Data

US 2016/0120763 A1 May 5, 2016

Related U.S. Application Data

(60) Provisional application No. 62/069,963, filed on Oct. 29, 2014.

(51) Int. Cl.
*A61J 13/00* (2006.01)

(52) U.S. Cl.
CPC ..... *A61J 13/00* (2013.01)

(58) Field of Classification Search
CPC ..... A61J 13/00; A61J 9/0607; A61M 1/068
See application file for complete search history.

(56) References Cited

U.S. PATENT DOCUMENTS 322,508 A * 7/1885 Ware ..... A61M 1/06 604/76
1,156,202 A * 10/1915 Barrett ..... A61J 13/00 604/76
2,054,491 A 9/1936 Tynan
2,364,866 A * 12/1944 Meynier, Jr. ..... A61J 13/00 128/890
2,495,307 A 1/1950 Abramson
3,172,561 A * 3/1965 Schwartz ..... A61J 9/00 215/11.1
4,270,538 A 6/1981 Murphy
4,794,915 A 1/1989 Larsson
5,032,103 A 7/1991 Larsson
5,100,406 A 3/1992 Panchula
D246,729 S 12/1997 Murphy
5,843,029 A * 12/1998 Bachman ..... A61M 1/06 604/115
5,897,580 A 4/1999 Silver
6,440,100 B1 8/2002 Prentiss
6,481,986 B1 11/2002 Silver et al.
6,887,218 B2 5/2005 Warburton
6,962,519 B1 11/2005 Clark
6,968,964 B2 * 11/2005 Gilmore ..... A61J 11/0005 128/890
7,559,915 B2 7/2009 Dao et al.
(Continued)

*Primary Examiner* — Nathan R Price
*Assistant Examiner* — Dung Ulsh
(74) *Attorney, Agent, or Firm* — Doster Greene, LLC

(57) ABSTRACT

A breastfeeding system according to various embodiments can include a breast shield, a cut-out portion, and a supplement delivery device. The breast shield is formed to closely attach to the contours of a human female breast. The cut-out portion is provided within the breast shield to facilitate skin-to-skin contact between the mother and infant during breastfeeding. The supplement delivery device is provided within the breast shield to deliver a nutritional supplement to the infant while breastfeeding.

10 Claims, 7 Drawing Sheets

(56) References Cited

U.S. PATENT DOCUMENTS 7,896,835 B2 * 3/2011 Dahan ..... A61B 5/4288 604/73
8,357,117 B2 * 1/2013 Sokal ..... A61J 7/0053 426/85
8,460,233 B2 * 6/2013 McCoy ..... A61J 13/00 604/74
8,469,771 B2 6/2013 Francis
8,597,234 B2 12/2013 Larsson
8,672,877 B2 * 3/2014 Gust ..... A61J 11/00 119/71
9,060,917 B1 * 6/2015 Tronson ..... A61J 9/00
2004/0182813 A1 * 9/2004 Gilmore ..... A61J 11/0005 215/11.4
2005/0059927 A1 * 3/2005 Buiatti ..... A61J 13/00 604/74
2005/0092328 A1 * 5/2005 Herrick ..... A61M 16/0488 128/207.17
2005/0134040 A1 * 6/2005 Andre ..... F16L 37/144 285/305
2006/0157065 A1 * 7/2006 Rohrig ..... A61J 13/00 128/890
2007/0255149 A1 * 11/2007 DeCampli ..... A61B 17/12022 600/509
2008/0045888 A1 * 2/2008 Edwards ..... A61J 11/0005 604/76
2009/0283101 A1 * 11/2009 Mans ..... A61J 13/00 128/890
2010/0288282 A1 * 11/2010 Brewer ..... A61M 16/0463 128/207.14
2011/0065360 A1 * 3/2011 Francis ..... A61J 13/00 450/81
2013/0270140 A1 * 10/2013 Tronson ..... B65D 25/00 206/457
2014/0008317 A1 * 1/2014 Yang ..... A61J 11/00 215/11.1
2015/0283350 A1 * 10/2015 Miller ..... A61M 16/0825 128/204.17

* cited by examiner

BREASTFEEDING APPARATUS SYSTEM

I. RELATED APPLICATIONS

This application claims priority of U.S. Provisional Patent Application Ser. No. 62/069,963, which was filed on Oct. 29, 2014. The subject matter of the earlier filed application is hereby incorporated by reference.

II. FIELD OF THE INVENTION

The present disclosure relates to breast shields for feeding and nursing newborns.

III. BACKGROUND OF THE INVENTION

A mother's breast milk is usually the best source of nourishment for an infant. However, there are circumstances under which conventional breastfeeding can be challenging for some women. A breastfeeding shield (also commonly referred to as a "breast shield", "nipple shield" or "nipple guard") can be used as a tool to help assist some infants with breastfeeding or to protect a mother's sore or damaged nipples.

Breastfeeding shields are artificial nipples worn over the areola and nipple during a feeding. For some women, the only way they will ever be able to breastfeed is with a breast shield, where for others it is just a temporary solution. There are many different reasons why the use of a breastfeeding shield may be recommended. For example, sometimes it is recommended for low milk expression/supply, inverted or flat nipples, engorged breasts, nipple confusion/nipple preferences, premature infants, neurological challenges of the infant, and breast refusal.

Apparatus and methods consistent with the present teachings are directed at overcoming one or more of the conventional breastfeeding problems. For instance, it may be desirable to provide a breastfeeding that provides the ability to prime the breastfeeding shield with nutritional supplements, while maintaining the infant's latch and reducing leakage of the supplement. It may also be desirable to provide a breastfeeding system that insures adequate consumption of milk and similar liquids which are essential to the health and proper growth of a nursing infant.

In order to minimize the amount of air ingested by a nursing infant, it may desirable to provide a breastfeeding shield which minimizes the amount of air entrapped therein or admitted therein. It also may be desirable to provide a breastfeeding system that is relatively efficient and simple in terms of design and implementation.

IV. SUMMARY OF THE INVENTION

The present invention may satisfy one or more of the above-mentioned desirable features. Other features and/or advantages may become apparent from the description which follows.

In at least one aspect, the present disclosure provides a breastfeeding system, comprising a breast shield, a cut-out portion, and a supplement delivery device. The breast shield is formed to closely attach to the contours of a human female breast. The cut-out portion is provided within the breast shield. The supplement delivery device is provided within the breast shield to deliver a nutritional supplement to an infant while breastfeeding.

V. BRIEF DESCRIPTION OF THE DRAWINGS

Figure 1:
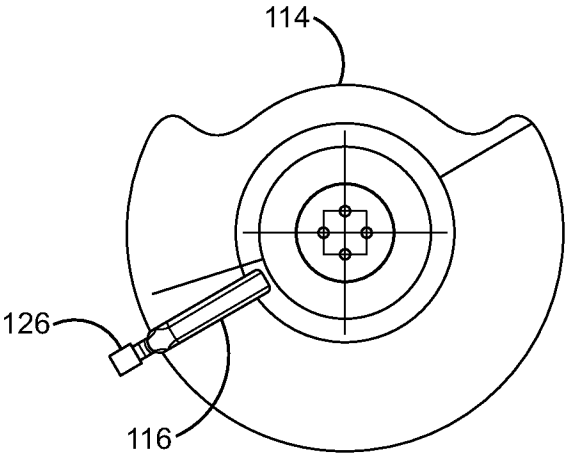
FIG. 1 illustrates a top view of a breastfeeding assistance system in accordance with the present teachings.

The present disclosure may take form in various components and arrangements of components, and in various process operations and arrangements of process operations. The present disclosure is illustrated in the accompanying drawings, throughout which, like reference numerals may indicate corresponding or similar parts in the various figures. The drawings are only for purposes of illustrating preferred embodiments and are not to be construed as limiting the disclosure. Given the following enabling description of the drawings, the novel aspects of the present disclosure should become evident to a person of ordinary skill in the art.

VI. DETAILED DESCRIPTION OF VARIOUS EMBODIMENTS

The following detailed description is merely exemplary in nature and is not intended to limit the applications and uses disclosed herein. Further, there is no intention to be bound by any theory presented in the preceding background or summary or the following detailed description.

Throughout the application, description of various embodiments may use "comprising" language, however, it will be understood by one of skill in the art, that in some specific instances, an embodiment can alternatively be described using the language "consisting essentially of" or "consisting of."

For purposes of better understanding the present teaching and in no way limit the scope of the teachings, it will be clear to one of skill in the art that the use of the singular includes the plural unless specifically stated otherwise. Therefore, the terms "a," "an" and "at least one" are used interchangeably in this application.

Unless otherwise indicated, all numbers expressing quantities percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained. In some instances, "about" can be understood to mean a given value ±5%. Therefore, for example, about 100° F., could mean 95-105° F. At the very least, each numerical parameter should at least be construed in light of the number of reported significant digits and by applying ordinary rounding techniques.

While embodiments of the present technology are described herein primarily in connection with breastfeeding shields, the concepts are also applicable to other types of infant feeding devices, such as breast shields, nipple shields, nipple guards, bottle nipples, breast pumping systems, finger feeding systems, periodontal syringe systems, and/or similar infant nursing systems.

Various embodiments provide a breastfeeding assistance system that includes one or more channels integrally formed within the breast shield for introducing and regulating the flow of a supplement or any other liquid into the breast shield. This configuration is in contrast to some conventional device wherein the tube is located under the device such that the tube is positioned between the breast shield and the mother's breast, or positioned over the device at a location between the breast shield and the baby's mouth. Thus, this configuration provides more comfort to the mother and nursing infant.

Thus, the configurations according to the present teaching reduce the risk of leakage while breastfeeding. Various embodiments of the breastfeeding assistance system describe a breastfeeding shield wherein the supplemental feeding tube is positioned toward the outer edge of the shield (as opposed to a point inside or outside of the shield more toward the center of the nipple) further reducing the need to adjust the tube frequently during breastfeeding, and enabling less interference with the baby's latch.

In various embodiments, the breastfeeding assistance system can accommodate both branded sized feeding tubes and generic sized feeding tubes allowing the user more options regarding the choices of devices used and the manner in which fluid is introduced (e.g., a gravity fed nursing system, vs. pushing fluid by way of a syringe with a tube attached). In some embodiments, a plurality of holes are provided inside the nipple portion for surrounding the nipple with fluid, potentially stimulating nipple erection (helping inverted nipples), stimulating milk production, and resulting in more sucking by an infant than in a single point of entry. Some embodiments are configured having a flat channel instead of a round channel, further reducing potential discomfort or interference with the baby's latch.

Figure 2:
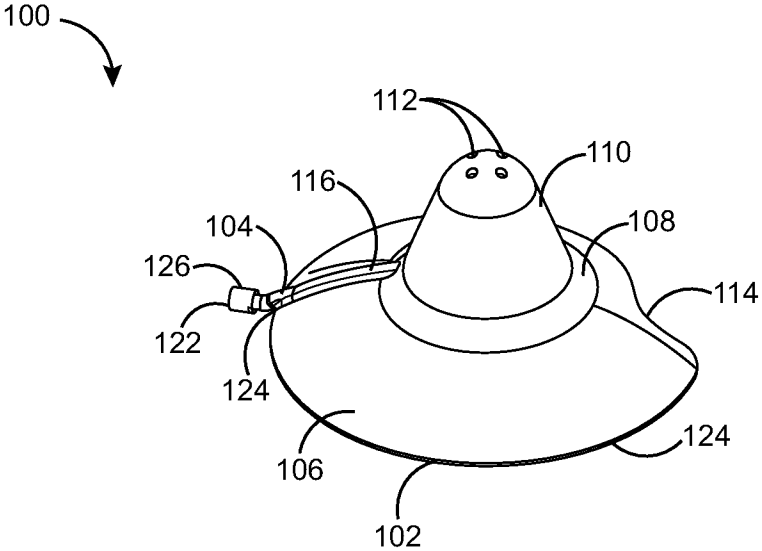
FIG. 2 illustrates a perspective view of a breastfeeding assistance system in accordance with the present teachings.
Figure 3:
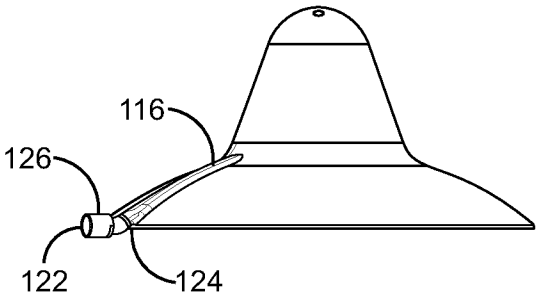
FIG. 3 illustrates a side view of a breastfeeding assistance system in accordance with the present teachings.

An exemplary embodiment of a breastfeeding assistance system 100 that can be used, for example, to assist with the feeding of a nursing infant is illustrated in FIGS. 1-3. The breastfeeding assistance system 100 includes a breast shield 102 formed of a thin, soft, pliable elastomeric material, such as silicon, natural rubber, synthetic rubber, latex or other suitable material. Preferably, the material is transparent, translucent or opaque. In some embodiments, colors or dyes may be added to the breast shield 102.

The breast shield 102 is molded or formed to conform closely to the contours of a human female breast. The breast shield 102 is readily attached to the mother's breast in a manner which lessens the amount of air entrapped therein or admitted thereto in order to minimize the amount of air ingested by the nursing infant. The breast shield is engageable with the breast to produce an effective seal against the leakage of air to the interior of the shield. The breast shield 102 may be manufactured in a wide range of sizes to properly accommodate a human's female breast, which can vary widely in size and other physical characteristics.

Various embodiments of the breastfeeding assistance system 100 can be configured to provide a right hand configuration and a left hand configuration that may be associated with each breast and depending on the type of nursing position used to hold and support an infant in a comfortable position during feeding. The breastfeeding assistance system 100 can be manufactured to accommodate various nursing positions, such as a cradle hold, a cross-over hold, a clutch or football hold, and a reclining position.

The breast shield 102 comprises a hollow, flared enlarged breast portion 106, generally a hemispherical breast cup, which fits closely by suction upon a major area of the breast. An areola portion 108 is located in the central area of the breast portion 106. The areola portion 108 aligns with and conforms to the areola when placed over the female breast. A nipple portion 110 extends outwardly from the areola portion 108. The nipple portion 110 defines a hollow nipple receiving portion, which is substantially the same size of a female nipple. The nipple portion 110 is provided with one or more openings 112 at its outer end for the passage of fluid therefrom. Thus, the nipple portion 110 may be configured to accommodate the size of the infant's mouth and enhance the ability to latch onto and suck breast milk from the breast shield 102.

In some embodiments, the breast shield 102 may be provided with at least one cut-out area 114. The cut-out area 114 is provided within the breast portion 106 to accommodate the infant's nose. The cut-out area 114 further enables skin-to-skin contact between the mother and infant to facilitate bonding. The breast shield 102 can be manufactured to have a cut-out area 114 of any desired shape. In lieu of the cut-out area 114, other embodiments of the breast shield 102 may be configured such that the outer edge 124 of the shield uniformly surrounds the breast, for example, having a round configuration.

A supplement delivery device 104 is provided within the breast portion 106 of the breast shield 102 to deliver nutritional supplement to an infant while breastfeeding. The supplement delivery device 104 contains a supplement channel 116 which extends from the outer edge 124 of the breast shield 102 to the areola portion 108 in order to insure the infant's consumption of essential supplemental nutrients. In FIGS. 1-3 and 8-10, an attachment portion 126 is provided at the outer edge 124 extending outward from the breast shield 102 and for connecting the supplement channel 116 to a supplemental fluid source (not shown). The connection of the supplemental fluid source to the attachment portion 126 provides a fluid communication from the fluid source through the breast portion 106 to the areola portion 108. The supplement channel 116 is configured within an integral portion of the breast portion 106 and functions as a passage way through with the supplement or any liquid flows and enters the areola portion 108 through during use of the device.

Figure 6:
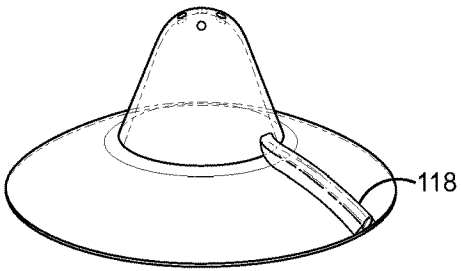
Figure 7:
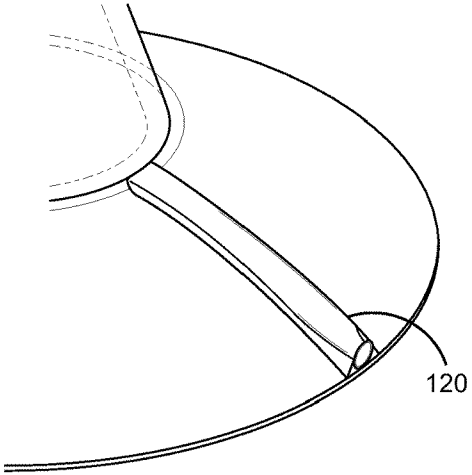
FIG. 7 illustrates an exemplary embodiment of a breast shield comprising a flat channel in accordance with the present teachings.
Figure 9:
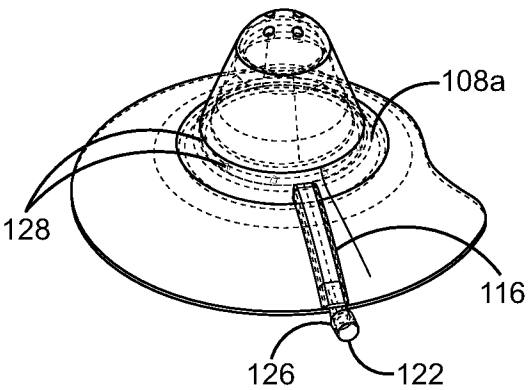
FIG. 9 illustrates a perspective view of the device of FIG. 8 according to the present teachings.
Figure 10:
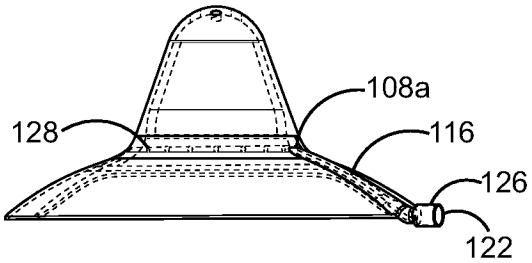
FIG. 10 illustrates a side view of the device of FIG. 8 according to the present teachings.
Figure 8:
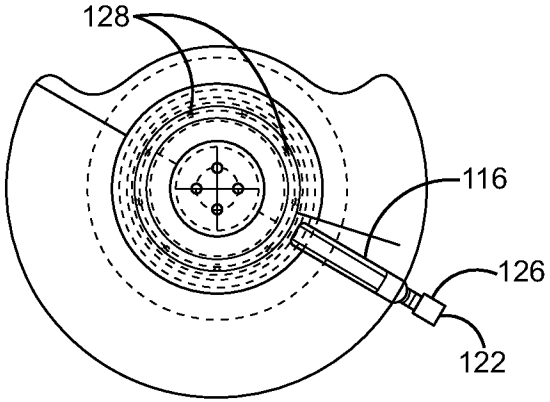
FIG. 8 illustrates a top view of another exemplary embodiment of a breastfeeding assistance system in accordance with the present teachings.
Figure 11:
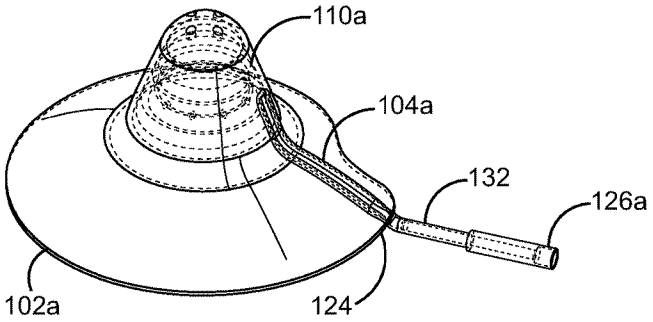
FIG. 11 illustrates a perspective view of yet another exemplary embodiment of a breastfeeding assistance system in accordance with the present teachings.
Figure 12B:
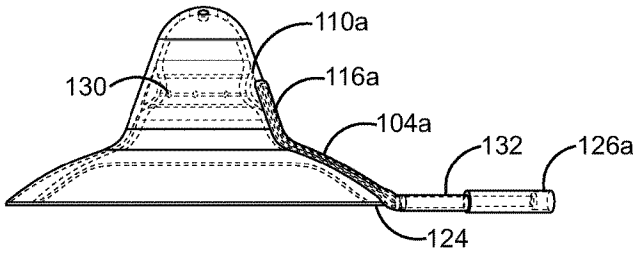
FIG. 12B illustrates a side view of the device of FIG. 12A comprising a channel positioned on the right side of the breast shield.
Figure 12A:
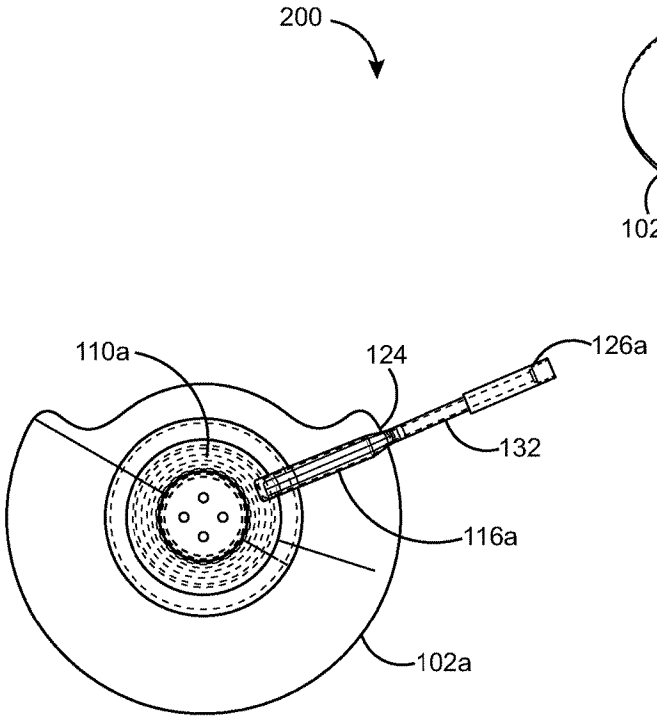
FIG. 12A illustrates a top view of the device of FIG. 11 comprising a channel positioned on the right side of a breast shield.

In some embodiments, the areola portion 108 can be configured such that the supplement or any liquid enters the areola portion 108 at a single point of entry, for example, as shown in FIGS. 4, 5, 6, and 7. In other embodiments, as shown in FIGS. 8-10, the ring of the areola portion 108 can be configured having a plurality of holes 128 such that the supplement or any liquid can enter the areola portion 108 from multiple sides.

In various embodiments, as shown in FIGS. 11-14, the nipple portion 110*a*, 110*b* can be configured such that the supplement or any liquid enters the nipple portion 110*a*, 110*b* at a single point of entry or at multiple points of entry. In some embodiments, as shown in FIGS. 11-14, the ring of the nipple portion 110*a*, 110*b* can be configured having a plurality of holes 130 such that the supplement or any liquid can enter the nipple portion 110*a*, 110*b* from multiple sides.

Figure 13A:
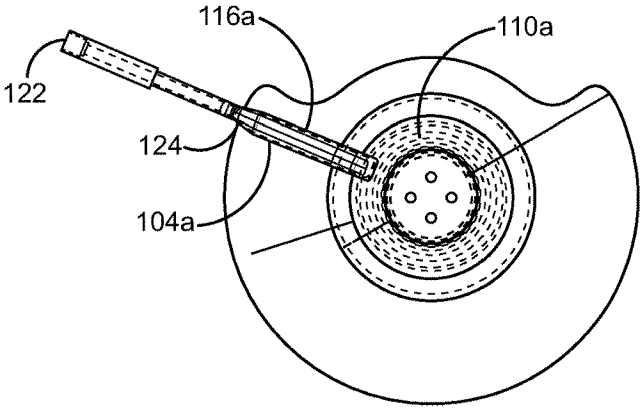
FIG. 13A illustrates a top view of the device of FIG. 11 comprising a channel positioned on the left side of the breast shield.
Figure 13B:
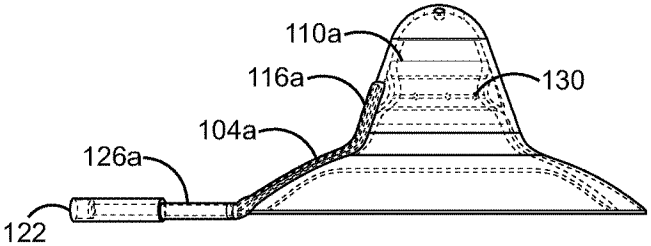
FIG. 13B illustrates a side view of the device of FIG. 13A comprising a channel positioned on the left side of the breast shield.

In the exemplary embodiments of FIGS. 11-13B, the supplement delivery device 104*a* includes a supplemental channel 116*a* that extends from the outer edge 124 of the breast shield 102*a* to the nipple portion 110*a* to provide a passage way through which the supplement or any liquid flows and enter the nipple portion 110*a*. FIGS. 12A-13B illustrate that the breastfeeding assistance system 200 can be configured in either a right hand configuration or a left hand configuration which can be used to facilitate various nursing positions. In FIGS. 12A-12B, the supplement delivery device 104*a* is provided on the right side of the breast shield 102*a*. In FIGS. 13A-13B, the supplement delivery device 104*a* is provided on the left side of the breast shield 102*a*.

Figure 14:
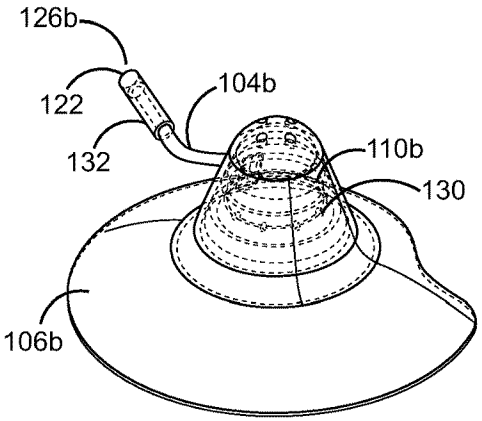
FIG. 14 illustrates a further exemplary embodiment of a breastfeeding assistance system in accordance with the present teachings.

In the exemplary embodiment of the breastfeeding assistance system 300 shown in FIG. 14, the supplement delivery device 104*b* connects from the supplement fluid source (not shown) directly to the nipple breast portion 110*b*, and does not extend through breast portion 106*b*.

An opening 122 is provided at the end of the channel for attaching a supplement supply tube (not shown) of the supplement fluid source to deliver the supplement to the breast shield at the attachment portion 126, 126*a*, 126*b*. In various embodiments, an enclosure (not shown), such as a cap, may be provided to prevent air from entering the device when the supplement delivery device is not in use. In some embodiments, at least one valve may be included within the attachment portion 126, 126*a*, 126*b* and located at a suitable position therein.

In FIGS. 1-3 and 8-10, the attachment portion 126 includes a short tubing configuration such that the attachment portion 126 substantially abuts the outer edge 124 of the breast shield. In FIGS. 11-14, the attachment portion 126*a*, 126*b* may include a longer tube 132 that extends the attachment portion 126 outwardly from the breast shield.

Figure 4:
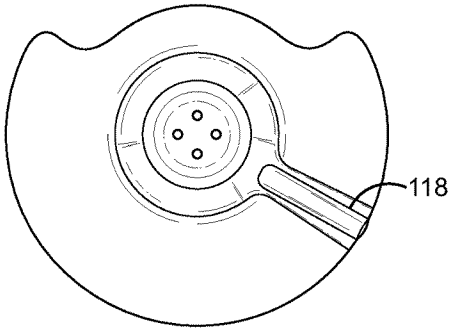
FIGS. 4-6 illustrate an exemplary embodiment of a breast shield comprising a round channel in accordance with the present teachings.
Figure 5:
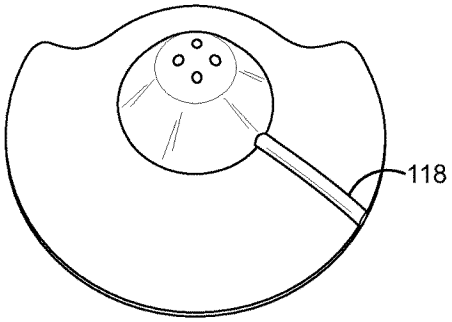

In some embodiments, the geometry and dimensions may be configured having application-specification characteristics to result in efficient delivery of the supplement through the breast shield 102 to the infant. For example, in various embodiments as depicted in FIGS. 4-6, the supplement channel 118 may be configured having a round configuration. In the preferable embodiment, as shown in FIG. 7, the supplement channel 120 is configured having a flat configuration, which is less prohibitive to the infant's latching onto the breast.

Figure 16:
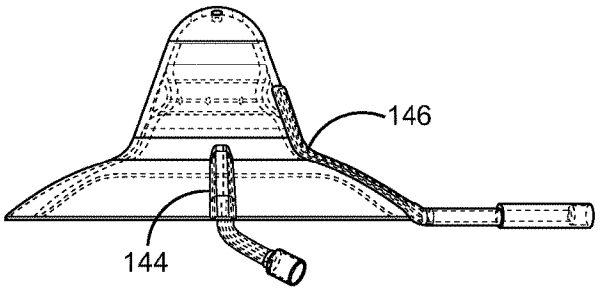
FIG. 16 illustrates yet another exemplary embodiment of a breastfeeding assistance system in accordance with the present teachings.
Figure 15:
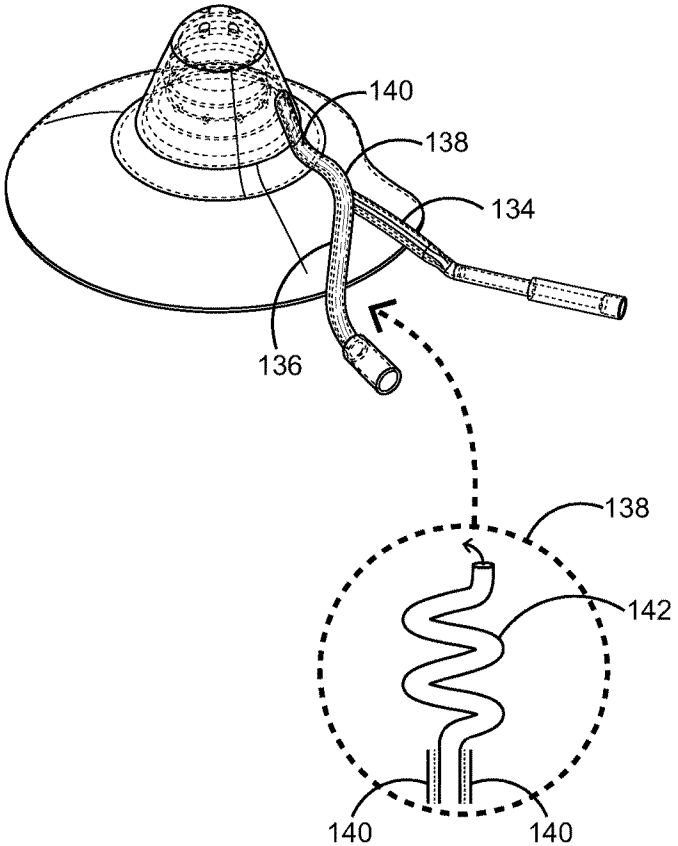
FIG. 15 illustrates another exemplary embodiment of a breastfeeding assistance system in accordance with the present teachings.

In various embodiments as depicted in FIGS. 15 and 16, the breast shield can be configured to deliver different supplements at different time intervals during the feeding or at different flow rates. For example, the breast shield can include two or more supplement channels, which can permit the introduction of the different supplements at different times during the feeding without removal of the breast shield from the breast. For instance, a supplement can be supplied in one channel and a medication can be supplied in a different channel near the end of the feeding session without removal of the breast shield.

In some embodiments as shown in FIG. 15, the two or more supplement channels (134, 136) may intersect at a connection point 138 leading to a main supplement channel 140 that extends to the areola portion and/or the nipple portion. A turbulator or a mixing mechanism 142 (i.e. a flow perturbing member) may be included at the connection point 138 or at a location within the main supplement channel for promoting mixing of the different fluids as they pass through the main supplement channel 140. In another embodiment comprising two or more channels, a first supplement channel may extend to the areola portion, while a second supplement channel may extend to the nipple portion.

Figure 17A:
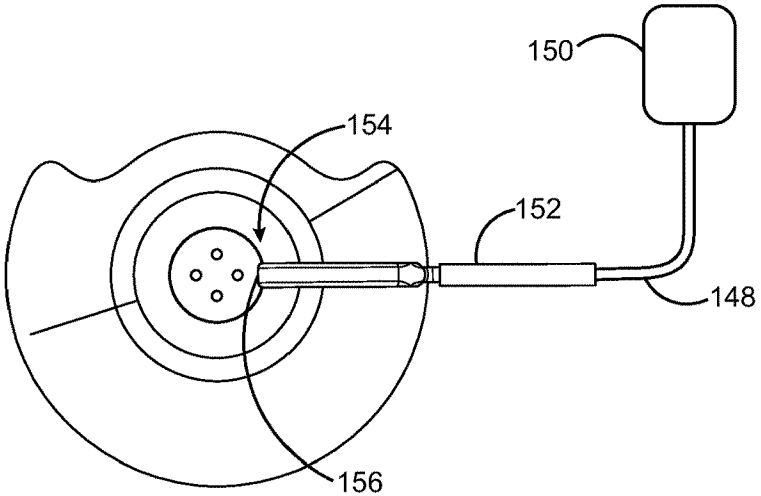
FIGS. 17A-17C illustrate a further exemplary embodiment of a breastfeeding assistance system in accordance with the present teachings.
Figure 17B:
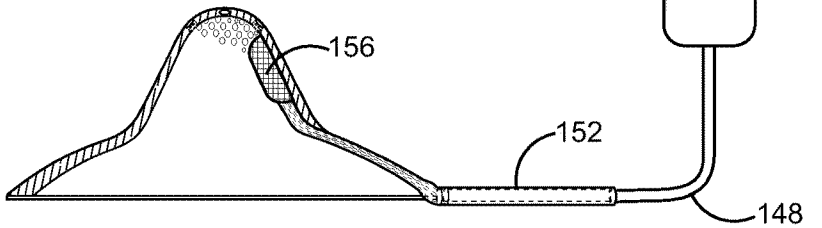
Figure 17C:
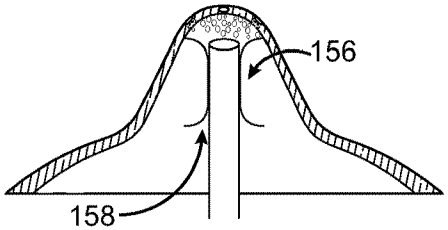

In another embodiment as shown in FIGS. 17A-17C, a tube 148 extending from a supplement feeding device 150 can be inserted through a channel 152 (instead of connecting to an attachment portion) such that the tube 148 extends into the inner areola portion 154 of the device. A connection mechanism 156 configured having, for example, a U-shaped configuration can be provided in the inner wall of the areola portion 154. Due to the U-shaped configuration of the connection mechanism 156, the tube 148 is capable of extending from the entry point 158 where the tube enters the areola portion upward toward the tip of the nipple. The purpose of the U-shaped feature of the connection mechanism 156 is to connect or snap the tube 148 into place, thus preventing it from moving, and directing the flow of the supplement toward the tip of the nipple when in use.

In various embodiments, one or more channels can be configured having various configurations to control and manage the fluid flow. For example, the channel can be configured such that the diameter gradually increases or decreases. Thus, various breast shields 102 can be formed with different channel configurations or shapes and selected based on the type of nutritional supplement supplied through the tubing. Other mechanisms, in addition or alone, may be employed to regulate the flow of fluid. For example, to vary or adjust the rate of consumption by the infant of a particular supplement or liquid, one or more of the channels can be configured having notches or other indentations such as a round, triangle or square configuration to slow the infant's rate of consumption.

The breast shield may be manufactured in a wide range of sizes to properly accommodate a human's female breast, which can vary widely in size and other physical characteristics. For example, in some embodiments, the breastfeeding assistance system can be configured having a height within the range of approximately 1 to 2 inches. In some embodiments, the breast shield can be configured having an outer most diameter of approximately 2.0 to 3.5 inches. In some embodiments, the tubing of the attachment portion can be adapted to receive tubing having a diameter of approximately 0.050 to 0.200 inches. It should be understood that the above-listed dimensions are nonlimiting and exemplary only. Those skilled in the art would understand that various sizes, shapes, and configurations may be envisioned for the components of the breastfeeding assistance system without departing from the scope of the present teachings. Moreover, configurations and number of channels may be selected so as to achieve a desired nursing position, feeding consumption rate, and mixture of different liquids supplied to the infant during nursing.

During use, an infant latches on the nipple portion 110, 110*a*, 110*b*, and, upon application of suction, the supplement or any other liquid is drawn through the supplement delivery device 104, 104*a*, 104*b* and received within the areola portion 108, 108*a*. In the nipple portion 110, 110*a*, 110*b*, the supplement or liquid then mixes with any breast milk produced by the breast and delivered to the breastfeeding infant when a mother's milk supply is insufficient.

Furthermore, taping of the supplement channel may not be necessary as it is required in some conventional devices. The breastfeeding system 100, 200, 300 can also attach to both branded supplement feeding systems and over the counter-supplement syringe that includes tubing.

Numerous benefits are achieved through the attributes and use of the breastfeeding assistance system 100, 200, 300. The features of the breastfeeding assistance system described above can provide benefits, for example, that:

(1) Facilitate nutrient supplementation while maintaining a baby's latch (2) Reduce supplement leaks which tend to occur without shields (3) Encourage continual latching even during moments of low milk production (4) Maintain better shield to breast seal while supplementing (5) Promote milk expression by maintaining latch while introducing supplement as needed (6) Due to more successful nursing, may help to reduce stress/anxiety and enhance the mother's production of serotonin, (the "happy hormone")

(7) Require less set-up time and less clean-up after nursing (8) Provide a more compact and comfortable fit onto the breast and the tubing can be easily connected at the attachment portion which results in less supplement leaking, (9) Promote natural breastfeeding without the use of a pump for the purpose of inducing milk expression or stimulating inverted nipples

(10) May eventually enable the mother to nurse without using the device as milk production increases and inversion issues improve—which will stimulate the infant's desire for independently breastfeeding.

It will be apparent to those skilled in the art that various modifications and variations can be made to the system and method of the present disclosure without departing from the scope its teachings.

Other embodiments of the disclosure will be apparent to those skilled in the art from consideration of the specification and practice of the teachings disclosed herein. It is intended that the specification and examples be considered as exemplary only.

What is claimed is:

1. A breastfeeding system, comprising:

a breast shield formed to closely attach to the contours of a human female breast, and the breast shield having a top portion, a bottom portion, an interior surface and an exterior surface;

a cut-out portion provided at the top portion within the breast shield;

the cut-out portion having a sinuously-cut or wavy edge having a concave-convex-concave contour, the concave-convex-concave contour including:

first and second concave side surfaces, a first length of an arc defined by the first concave side surface being equal to a second length of an arc defined by the second concave side surface;

a convex side surface positioned between the first and second concave side surfaces, a third length of an arc defined by the convex side surface being greater than the first and second length of the arc of the first and second concave side surfaces;

at least one channel having a proximal end at an areola portion and an opposite distal end at an outer edge of the breast shield and the at least one channel integrally provided within the breast shield extending from the proximal end to the distal end;

the at least one channel is positioned proximate to the cut-out portion near the top portion of the breast shield for the reduction of leaks and to promote entry of fluid from a gravity fed nursing system and the channel is positioned closer to the top portion than the bottom portion;

a tube capable of extending longitudinally through the at least one channel and defining a flow path therethrough;

a connector provided within the breast shield for connecting the tube to the interior surface of the breast shield, wherein the interior surface defines a breast-facing surface;

the connector configured having a first convex member and a second convex member arranged generally along or extending from at least a portion of a longitudinal axis of the at least one channel and terminating at the areola portion such that the connector extends from the interior surface that defines the breast-facing surface, wherein the first convex member is positioned opposite the second convex member forming a concave opening therebetween, and the first and second convex members are configured to exert opposing forces upon the tube for retention of the tube when the tube is inserted within the concave opening; and a supplement delivery device provided within the breast shield to deliver a nutritional supplement to an infant while breastfeeding.

2. The breastfeeding system of claim 1, further comprises the at least one channel integrally provided within the breast shield to supply the supplement to the infant.

3. The breastfeeding system of claim 2, further comprises the areola portion provided within the breast shield and the channel extends into the areola portion.

4. The breastfeeding system of claim 3, further comprises a single hole formed in the areola portion for flowing a supplement or the fluid into the areola portion of the breastfeeding system.

5. The breastfeeding system of claim 1, wherein the breast shield is configured to minimize an amount of air entrapped therein.

6. The breastfeeding system of claim 5, wherein the breast shield is made of an elastomeric material selected from the group comprising silicone, natural rubber, synthetic rubber and latex.

7. The breastfeeding system of claim 1, wherein the cut-out portion facilitates skin-to-skin contact between the human female breast and the infant.

8. The breastfeeding system of claim 1, wherein the cut-out portion is formed in a wall of a breast portion of the breast shield.

9. The breastfeeding system of claim 1, further comprises the tube having the supplement delivery device adjacent the distal end for supplying the supplement into a nipple portion of the breast shield during the breastfeeding.

10. The breastfeeding system of claim 9, further comprises the connector provided within the nipple portion for connecting the tube to an internal surface of the breast shield.

* * * * *